United States Patent [19]

Yamazaki

[11] Patent Number: 4,998,650

[45] Date of Patent: Mar. 12, 1991

[54] ROTARY NOZZLE ON A MOLTEN STEEL VESSEL

[75] Inventor: Noboru Yamazaki, Kanagawa, Japan

[73] Assignees: Nippon Rotary Nozzle Co., Ltd., Kawasaki; NKK Corporation, Tokyo; Kokan Kikai Kogyo Kabushiki Kaisha, Kawasaki; Tokyo Yogyo Kabushiki Kaisha, Tokyo, all of Japan

[21] Appl. No.: 381,120

[22] Filed: Jul. 17, 1989

[30] Foreign Application Priority Data

Aug. 12, 1988 [JP] Japan ..... 63-200081

[51] Int. Cl.[5] ..... B22D 41/26

[52] U.S. Cl. ..... 222/599; 222/591

[58] Field of Search ..... 222/591, 598, 599, 597, 222/590; 266/236

[56] References Cited

U.S. PATENT DOCUMENTS

| | | | |
|---|---|---|---|
| 3,430,644 | 3/1969 | Lyman | 222/598 |
| 4,498,611 | 2/1985 | Yoshihara | 222/599 |
| 4,591,080 | 5/1986 | Yoshihara | 222/598 |

*Primary Examiner*—S. Kastler

*Attorney, Agent, or Firm*—Ladas & Parry

[57] ABSTRACT

In a rotary nozzle of the type attached to the bottom shell of a molten street vessel and designed so that a rotor having a sliding plate brick mounted thereon is rotated by a motor through a reducer and gearing to adjust the degree of opening of a nozzle bore and thereby to control the pouring rate of molten steel, the rotation of the rotor is effected by hydraulic cylinders in place of the reducer, gearing and motor. Thus, there is the effect of providing a rotary nozzle which is small in size, light in weight and low in cost.

10 Claims, 5 Drawing Sheets

ROTARY NOZZLE ON A MOLTEN STEEL VESSEL

BACKGROUND OF THE INVENTION

1. Field of the Invention

The present invention relates to a rotary nozzle of the type which is attached to the bottom of a molten steel vessel, e.g., a laddle or tundish so that a sliding plate brick is rotated and the opening of a nozzle bore of a fixed plate brick is adjusted thereby controlling the pouring rate of molten steel, and more particularly the invention relates to a turning apparatus for a rotor which holds the sliding plate brick.

2. Description of the Prior Art

Rotary nozzles have been used widely with laddles for receiving the molten steel tapped from a converter or the like to transport or to pour the molten steel into molds, tundishes for receiving the molten steel from a laddle to pour the molten steel into molds and the like.

Referring to the accompanying drawings, FIG. 7 is a longitudinal sectional view showing schematically an example of a conventional rotary nozzle, and FIG. 8 is a bottom view of FIG. 7 with a part thereof being omitted. In the Figures, numeral 1 designates a shim plate mounted to the bottom of a laddle, tundish or the like, and 2 a base member attached to the shim plate and formed with a recess for mounting a fixed plate brick 3 therein and an opening into which a top nozzle 5 is fitted. Numeral 6 designates a rotor rotatably arranged on a movable member 11 through a ball bearing 12, formed with a recess in which a sliding plate brick 8 is mounted and an opening into which a bottom nozzle 10 is fitted and provided with a gear 7 on its upper outer periphery thereof. Numeral 13 designates a frame adapted to accommodate the rotor 6 and pivotably attached to the shim plate 1 by a hinge 14. It is to be noted that although not shown, the opposite side to the hinge 14 is secured to the shim member 1 with bolts, levers or the like. Numeral 15 designates springs mounted between the movable member 11 and the frame 13 and they are adapted to press the rotor 6 upward and force the sliding surface of the sliding plate brick 8 into close contact with the fixed plate brick 3.

Numeral 16 designates a motor, 17 a reduction gear, and 18 the final-stage gear of the reduction gear 17 which is in mesh with the gear 7 of the rotor 6.

With the construction described above, the operation of the rotary nozzle will now be described. In the illustrated condition, the nozzle bores of the top nozzle 5, the fixed plate brick 3, the sliding plate brick 8 and the bottom nozzle 10 are located on the same center, and the nozzle bore 9 of the sliding plate brick 8 is in a wide-open position relative to the nozzle bore 4 of the fixed plate brick 3. Therefore, the molten steel in the laddle or the like is poured into a tundish or the like in the maximum amount. To control the rate of pour of the molten steel, the motor 16 is operated so that the rotation reduced by the reduction gear 17 is transmitted to the rotor 6 through the gears 18 and 17, thereby rotating the rotor 6 through a desired angle. When this occurs, the opening of the nozzle bores 4 and 9 is adjusted to control the pouring rate of the molten steel.

Where it is desired to perform the desired maintenance, inspection, etc., or to replace the fixed plate brick 3 and the sliding plate brick 8, it is only necessary to pivotally rotate the frame 13 and the rotor 6 received in the former in a door-like manner by the hinge 14 as a pivot, thus exposing the sliding surfaces.

Rotary nozzles of this type have been recently used in large numbers owing to a number of advantages that the maintenance and inspection are easy, that the damages on the surfaces of the fixed plate brick 3 and the sliding plate brick 8 can be confirmed with the naked eye and they can also be replaced easily and so on.

However, the driving unit for the rotor 6, that is, the motor 16 and the reduction gear 17 which are attached to the bottom of the laddle or the like are extremely large in size and weight thus making it inconvenient to handle.

As a means of solving this difficulty, it is conceivable to rotate the rotor by a hydraulic cylinder or rocking actuator. However, the range of rotation of the rotor is limited by the stroke of the hydraulic cylinder or the rotational angle of the rocking actuator so that in order to increase the rotation range of the rotor, a hydraulic cylinder with a long and strong actuator or a rocking actuator with a large linkage is required and the above-mentioned problem still remains unsolved.

SUMMARY OF THE INVENTION

The present invention has been made to overcome the foregoing deficiencies and it is an object of the invention to provide a rotary nozzle equipped with a rotor driving unit which is small in size and light in weight.

To accomplish the above object, in accordance with the present invention there is thus provided a rotary nozzle including a rotor formed with a plurality of notched engaging portions at equal intervals on its outer periphery, a turning member rotatably arranged along the rotor and including detent means adapted to engage with the engaging portions and a locking mechanism for bringing the detent means into and out of engagement with the engaging portions, and a hydraulic cylinder having an actuator connected to the turning member.

In accordance with a further feature of the present invention, a gear is formed on the outer periphery of the turning member, and the hydraulic cylinder is replaced with a rocking actuator whose output side is connected to a gear which in turn is connected to the gear of the turning member.

In accordance with still further feature of the present invention, a belt member having a lining on its inner surface is arranged on the outer periphery of the rotor in a manner that the ends of the belt member are attached to a connecting member having a function of tightening and lossing the belt member, and the connecting member is connected to the actuator of the hydraulic cylinder.

In accordance with the invention, there is an effect that by operating the hydraulic cylinder or the rocking actuator, the rotor coupled with the turning member as a unit is selectively caused to make stepping rotary movements in the forward and backward directions through the turning member connected to the hydraulic cylinder or the rocking actuator and also the rotor is controlled by the locking mechanism, thereby rotating the rotor through a wide range of angles.

There is another effect that by tightening the belt member and operating the hydraulic cylinder connected thereto, the rotor is rotated in correspondence to the stroke of the actuator of the hydraulic cylinder and also the tightening and loosening of the belt member are repeated, thereby rotating the rotor through a wide range of angles.

DESCRIPTION OF THE PREFERRED EMBODIMENTS

Figure 1:
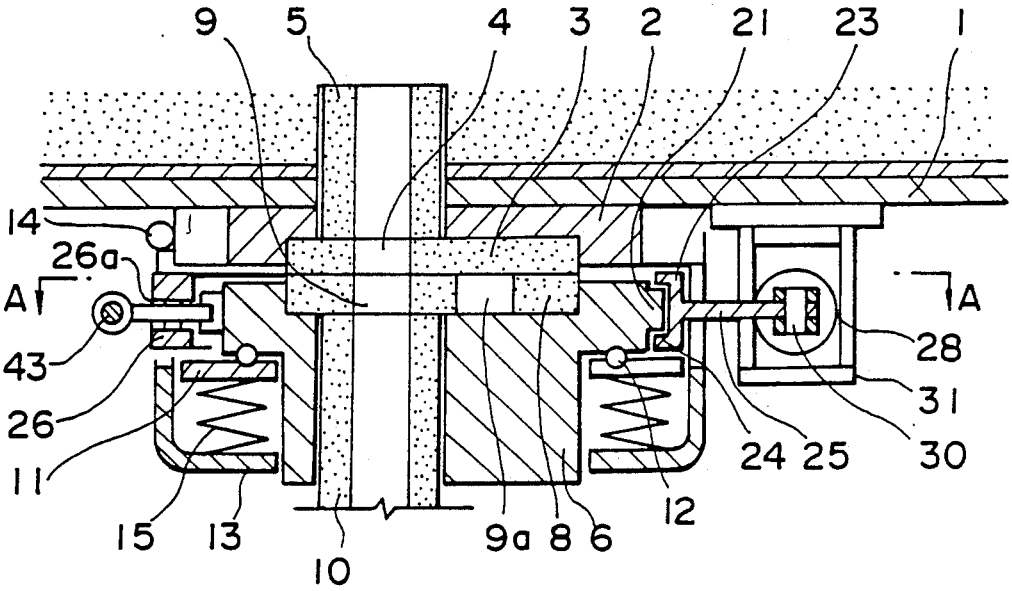
FIG. 1 is a longitudinal sectional view showing an embodiment of the present invention.
Figure 2:
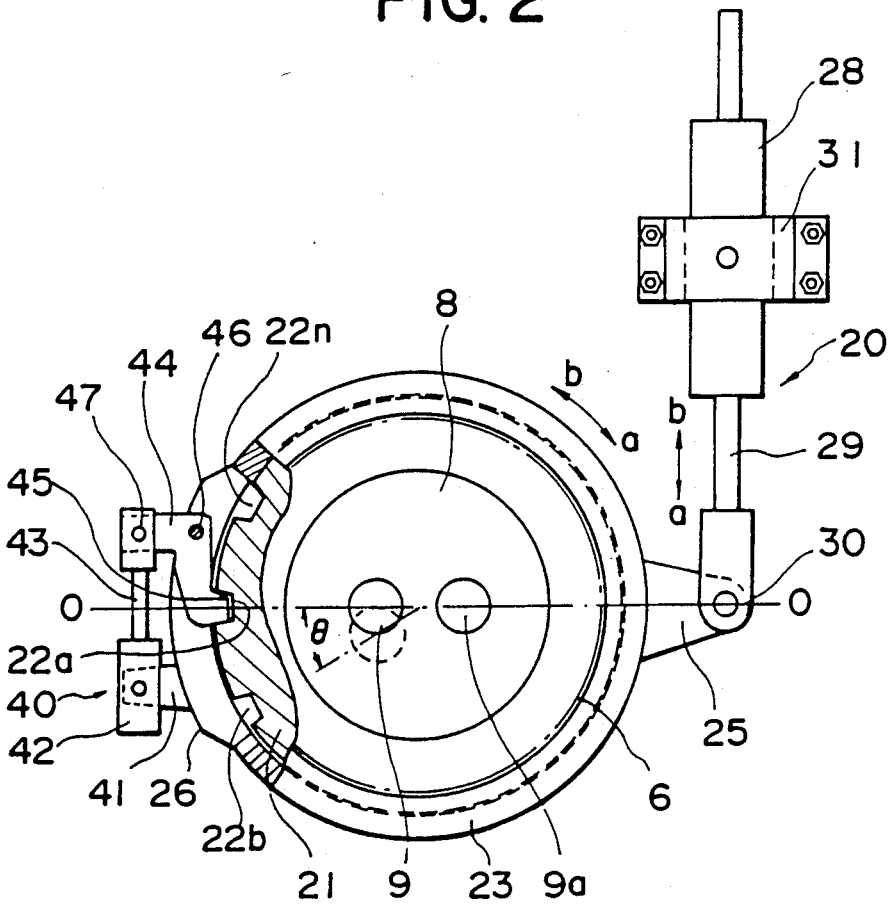
FIG. 2 is a partly cutaway sectional view taken along the line A—A of FIG. 1.
Figure 7:
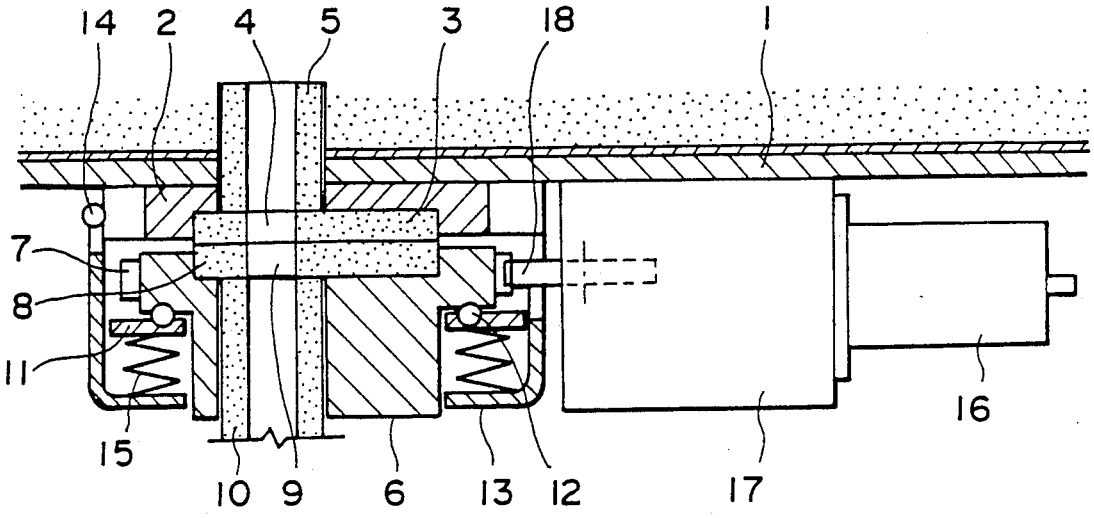
FIG. 7 is a front view showing an example of a conventional rotary nozzle with a part thereof shown in section.
Figure 8:
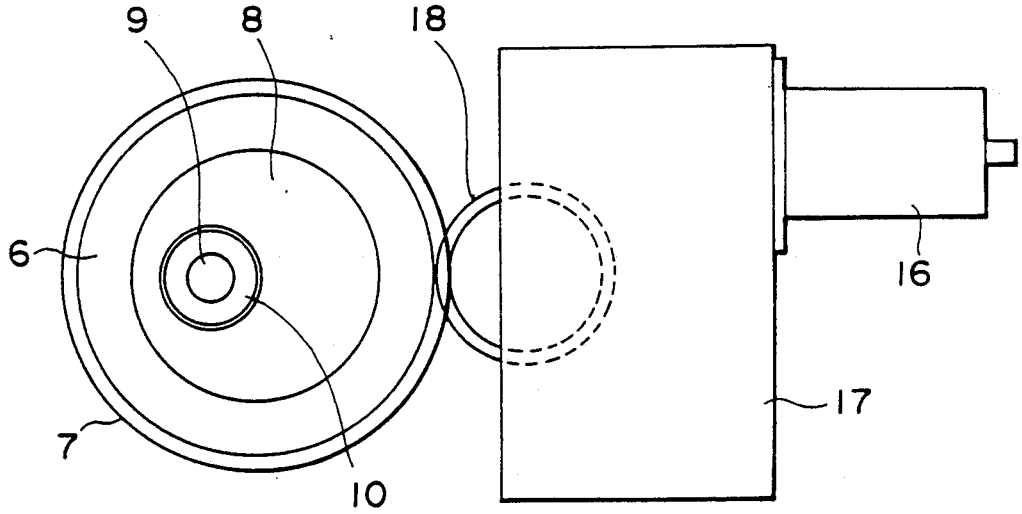
FIG. 8 is a bottom view of FIG. 7.

FIG. 1 is a longitudinal sectional view of an embodiment of the present invention, and FIG. 2 is a sectional view taken along the line A—A of FIG. 1. It is to be noted that those component parts which are identical or equivalent to their counterparts in the conventional rotary nozzle of FIGS. 7 and 8 are designated by the same reference numerals and their explanation will be omitted. Numeral 21 designates a ring portion provided on the upper outer periphery of a rotor 6 to be integral therewith and a plurality of notched engaging portions 22*a* to 22*n* are formed on its outer periphery at equal intervals (at intervals of 30° in this embodiment). Numeral 23 designates a shuttle ring having a C sectional shape and formed on its inner periphery with a groove 24 rotatably loose-fitted on the ring portion 21 of the rotor 6. The shuttle ring 23 includes an arm 25 and an outwardly projecting convex portion 26 on the opposite side to the arm 25. Numeral 42 designates a hydraulic cylinder attached by a support arm 41 to one side of the convex portion 26 of the shuttle ring 23 (in this embodiment the convex portion 26 is arranged over an extent of about 60° corresponding to the intervals of two of the engaging portions 22*a* to 22*n*). Numeral 44 designates a substantially Z-shaped lock member formed at its one end with a detent portion 45 for selectively engaging with the engaging portions 22*a* to 22*n* formed on the ring portion 21 and it is inserted into a slot 26*a* formed in the convex portion 26 with its substantially central portion being rotatably pivoted by a pin 46. The other end of the lock member 44 is pivotably connected to an actuator 43 of the hydraulic cylinder 42. It is to be noted that these component parts form a locking mechanism 40 for the rotor 6.

Numeral 28 designates a hydraulic cylinder mounted on a shim plate 1 by a fixture 31 and its actuator 29 has its forward end pivotably connected to the arm 25 of the shuttle ring 23 by a pin 30. It is to be noted that these component parts form a driving mechanism 20 for the rotor 6.

With the construction described above, the operation of the present embodiment will now be described.

(1) In the condition of FIGS. 1 and 2, the center of the nozzle bore 9 of the sliding plate brick 8 is positioned on the line 0—0 connecting the centers of the pin 30 and the rotor 6 so that the nozzle bores 4 and 9 of the fixed plate brick 3 and the sliding plate brick 8 are aligned and are in a fully opened condition.

(2) Assuming that the actuator 29 of the hydraulic cylinder 28 is retreated for example in the direction of an arrow b, the shuttle ring 23 is rotated in the direction of an arrow b so that the detent portion 45 of the lock member 44 is engaged with the engaging portion 22*a* and therefore the rotor 6 which is united with the shuttle ring 23 is rotated in the direction of the arrow b.

(3) When the operation of the hydraulic cylinder 28 is stopped after the shuttle ring 23 has been rotated 30°, for example, the nozzle bore 9 of the sliding plate brick 8 is moved to the corresponding position (shown by the broken line in FIG. 2) and a part of the nozzle bore 4 of the fixed plate brick 3 is closed.

(4) Then, as the actuator 43 of the hydraulic cylinder 42 of the locking mechanism 4 is moved forward or in the direction of an arrow a, the lock member 44 is pivoted about the pin 46 in the clockwise direction in the Figure and the detent portion 45 is disengaged with the engaging portion 22*a*.

(5) In this condition, when the actuator 29 of the hydraulic cylinder 28 of the driving mechanism 20 is moved forward in the direction of an arrow a, due to the fact that the shuttle ring 23 and the rotor 6 has been uncoupled, only the shuttle ring 23 is rotated in the direction of the arrow a. If, for example, the hydraulic cylinder 28 is stopped after the shuttle ring 23 has been rotated through 30°, the detent portion 45 of the lock member 44 is stopped in opposition to the next engaging portion 22*n* of the rotor 6.

(6) In this condition, if the actuator 43 of the hydrauric cylinder 42 is moved backward, the lock member 44 is pivoted about the pin 46 in the counterclockwise direction and the detent portion 45 is engaged with the engaging portion 22*n* thus providing locking again.

(7) By thus rotating the rotor 6 in the direction of the arrow a or b to adjust the nozzle bores 4 and 9 to any given degree of opening, the amount of molten steel to be poured can be controlled. Where the nozzle bore 9 of the sliding plate brick 8 is damaged by frequent charges, by rotating the rotor 6 through 180° in the direction of the arrow a or b in the above-mentioned manner, an unused nozzle bore 9 can be positioned opposite to the nozzle bore 4 of the fixed plate brick 3.

Figure 2A:
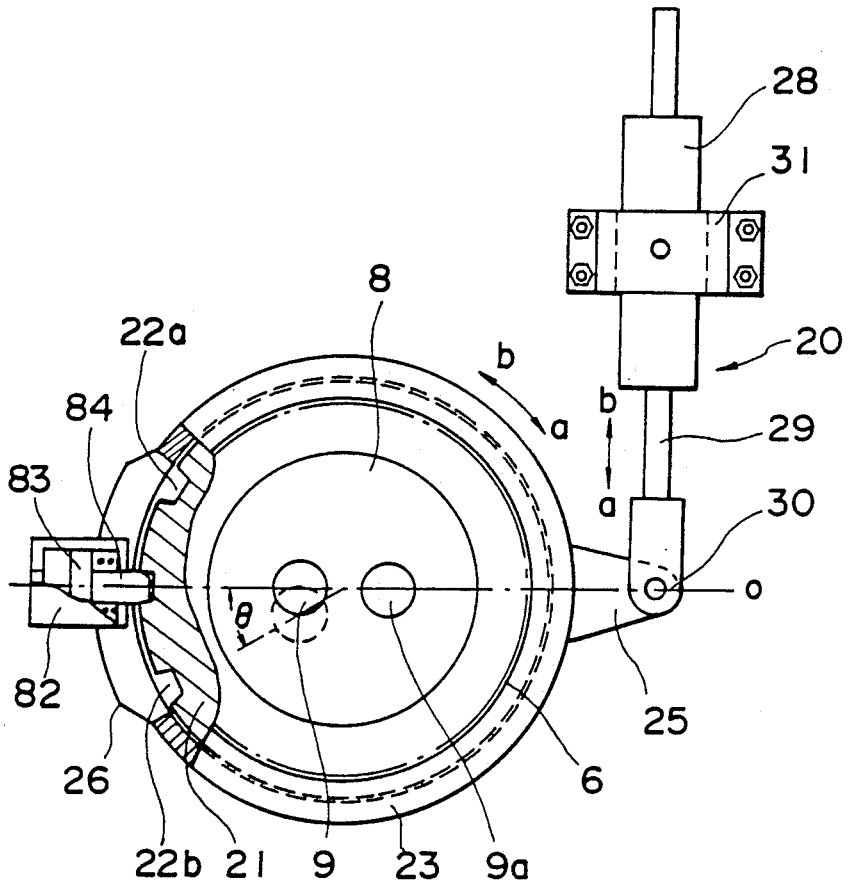
FIG. 2A shows a modification of the embodiment of FIG. 2.

Referring now to FIG. 2A, there is illustrated a modification of the embodiment of FIG. 2. This modification features that differing from the engaging means and locking means of FIG. 2, its locking means brings into and out of engagement with the notched engaging portions 22*a* to 22*n* a detent portion formed at one end of a piston rod 84 of a piston 83 operated by a hydraulic cylinder 82 which is directly attached to the turning member.

Figure 3:
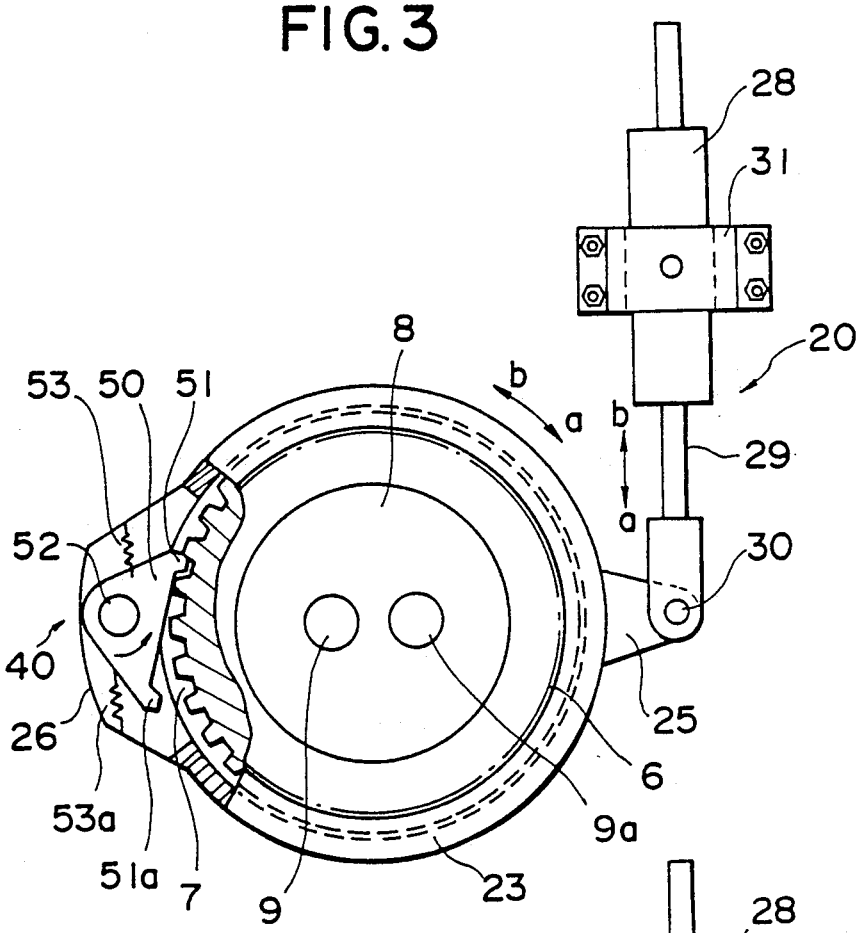
FIGS. 3, 4 and 5 are plan views (corresponding to the section along the line A—A of FIG. 1) showing respectively another embodiments of the invention.

Referring now to FIG. 3, there is illustrated another embodiment of the invention (corresponding to the sectional view taken along the line A—A of FIG. 1).

This embodiment differs from the embodiment of FIG. 1 in that a gear 7 is formed on the ring portion 21 of the rotor 6, and also a substantially triangular rocker 50 formed on its sides with locking pawls 51 and 51*a* for engagement with the gear 7 of the rotor 6 is pivotably attached by a pivot pint 52 to the convex portion 26. It is to be noted that the rocker 50 is pressed from its sides by springs 53 and 53*a*, respectively, and the spring forces of the springs 53 and 53*a* are adjustable by a control mechanism (not shown). Note that a driving mechanism 20 is the same as the embodiment of FIG. 1.

With the present embodiment constructed as described above, if, for example, the locking pawl 51 is engaged with the gear 7 of the rotor 6 thereby decreasing the spring force of the spring 53, a pivoting force in the direction of the arrow is imparted to the rocker 50 by the spring 53*a*, thereby pressing the side of the locking pawl 51 against the gear 7. Thus, while the rotation of the shuttle ring 23 in the direction of the arrow a causes the rotor 6 to rotate in the direction of the arrow a, the rotation of the shuttle ring 23 in the direction of the arrow b rotates only the shuttle ring 23 and the rotor 6 is not rotated. In the like manner, when the locking pawl 51*a* is engaged with the gear 7 so that the spring force of the spring 53*a* is decreased, the rotation of the shuttle ring 23 in the direction of the arrow b causes the rotation of the rotor 6, whereas the rotation of the shuttle ring 23 in the direction of the arrow a results in no rotation of the rotor 6.

As a result, by repeating the operation of moving forward the actuator 29 of the hydraulic cylinder 28 to the extent of the stroke, for example, thereby rotating the rotor 6 in one direction, then moving backward the actuator 29 to rotate only the shuttle ring 23 and then bringing the same locking pawl into engagement with the gear 7 and again moving the actuator 29 forward, the rotor 6 can be rotated a wide range of angles in the direction of the arrow a or b thereby adjusting the degree of opening of the nozzle bores 4 and 9.

Figure 4:
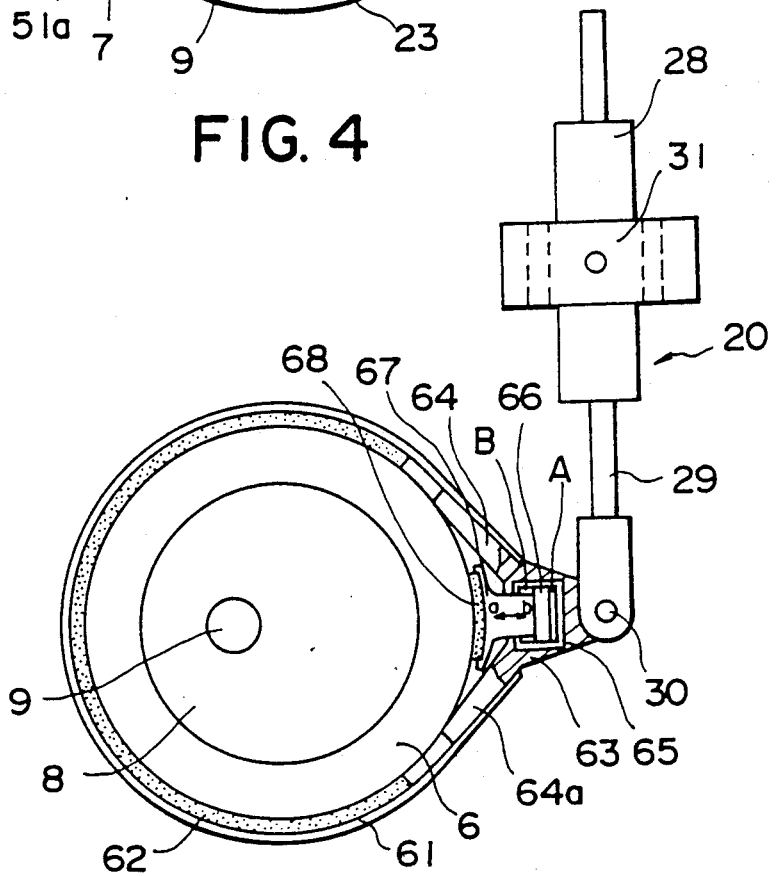

Referring now to FIG. 4, there is illustrated a plan view of another embodiment of the invention which differs from the embodiment of FIG. 1 as follows. Numeral 61 designates a belt member such as a steel belt wound on the outer periphery of the rotor 6 and its inner surface is provided with a lining 62 composed of a heat resisting material. Numeral 63 designates a substantially inverted Y-shaped connecting member whose body portion has its forward end pivotably connected to the actuator 29 of the hydraulic cylinder 28 by the pin 30 and its arms 64 and 64*a* secured to the ends of the belt member 61. Numeral 65 designates a hydraulic cylinder disposed in the body portion of the connecting member 63 and a rod 67 of its piston 66 is brought out from between the arms 64 and 64*a* of the connecting member 63 and has a friction member 68 composed of a heat resisting material attached to the forward end thereof.

The operation of this embodiment will now be described.

(1) In order to rotate the rotor 6, hydraulic pressure is applied to the chamber A of the hydraulic cylinder 65 for the connecting member 63 so that the piston 66 is moved forward in the direction of an arrow a to press the friction member 68 against the outer periphery of the rotor 6 and the connecting member 63 is displaced in the direction of an arrow b thereby binding the rotor 6 by the belt member 61.

(2) In this condition, by moving the actuator 29 of the hydraulic cylinder 28 forward or backward within the extent of its stroke, the rotor 6 can be rotated correspondingly.

(3) In order to rotate the rotor 6 further, hydraulic pressure is applied to the chamber B of the hydraulic cylinder 65 to move the piston 66 back in the direction of an arrow b, thus loosening the pressing on the friction member 67 and the binding of the belt member 61 and thereby setting the rotor 6 free.

In this condition, after the actuator 29 of the hydraulic cylinder 28 has been moved forward or backward, the friction member 68 is pressed against the rotor 6 and the belt member 61 is tightened thereby rotating the rotor 6 further. By performing such operation repeatedly, the rotor 6 is rotated to adjust the nozzle bores 4 and 9 to a desired opening.

Figure 5:
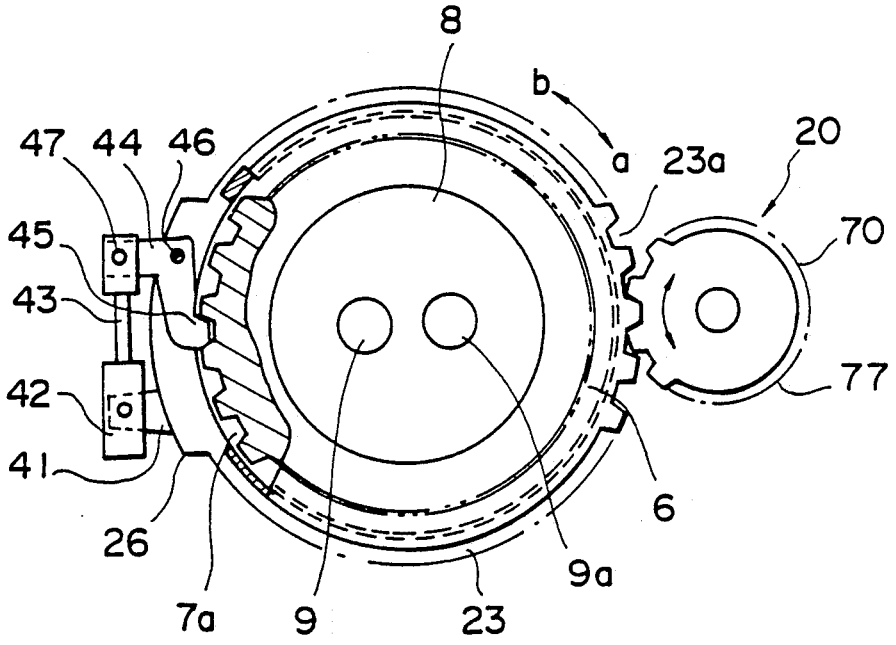
Figure 6:
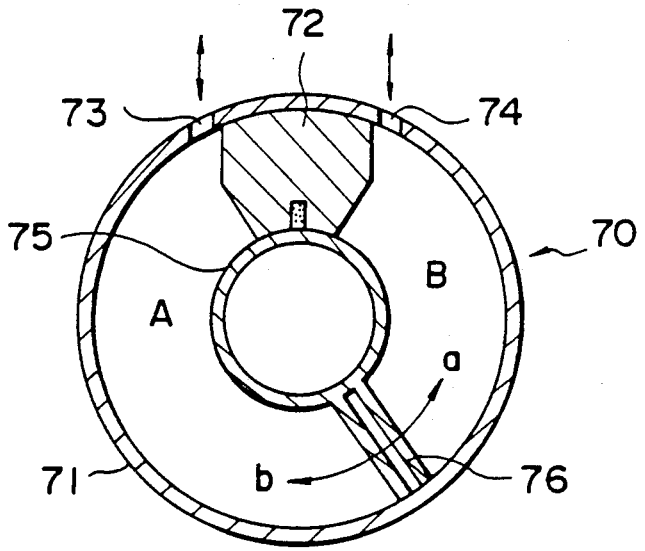
FIG. 6 is a partial sectional view of FIG. 5.

FIG. 5 is a plan view of still another embodiment of the invention which differs from the embodiment of FIG. 1 in that while the locking mechanism 40 is the same as in the embodiment of FIG. 1, a gear 23*a* is formed on the outer peripheral portion of the shuttle ring 23 other than the convex portion 26 and a gear 7*a* is formed on the outer periphery of the rotor 6 in correspondence to the gear 23*a*. Numeral 70 designates a rocking actuator and its exemplary form is shown in FIG. 6. Numeral 71 designates a cylindrical body having a partition wall 72 formed therein and hydraulic ports 73 and 74 are formed on the sides of the partition wall 72 of the body 71. Numeral 75 designates a rotary member rotatably arranged in the central portion of the body 71 and including a vane 76. The outer periphery of the rotary member 75 and the forward end of the vane 76 are respectively in fluid-tight sliding contact with the partition wall 72 and the inner wall of the body 71 thereby forming chambers A and B. Numeral 77 designates a gear connected to the rotary member 75 of the rocking actuator 70 and in mesh with the gear 23*a* of the shuttle ring 23.

Assuming now that the hydraulic port 74 of the rocking actuator 70 is opened and hydraulic pressure is introduced into the chamber A through the hydraulic port 73, for example, the hydraulic pressure is applied to the vane 76 and the rotary member 75 is rotated in the direction of an arrow a. As a result, the gear 77 connected to the rotary member 75 is driven in the direction of an arrow a and the shuttle ring 23 connected to the gear 77 and the rotor 6 are rotated in the direction of the arrow a. In the like manner, when the hydraulic port 73 is opened and hydraulic pressure is introduced into the chamber B through the hydraulic port 74, the rotary member 75 is rotated in the direction of an arrow b and the shuttle ring 23 and the rotor 6 are rotated in the direction of an arrow b through the gear 77 coupled to the rotary member 75.

In this way, by rotating the rotor 6 in the direction of the arrow a or b by the rocking actuator 70 and operating the locking mechanism 40, the degree of opening of the nozzle bores 4 and 9 is adjusted to a desired value or alternatively the sliding plate brick 8 is rotated through 180° thereby positioning the unused nozzle bore 9*a* opposite to the nozzle bore 4.

While, in the foregoing description, the present invention is applied to a rotary nozzle of the construction shown in FIG. 1, the present invention is also applicable to rotary nozzle of other constructions, e.g., a rotary nozzle of the type in which a frame is fastened to a base member or a shim plate with bolts or the like or a dual hinged-type rotary nozzle in which both a base member and a frame are opened and closed hingely.

In addition, while the hydraulic cylinders are used for the rotor driving mechanism and the locking mechanism, they may be replaced with air cylinders. Also, the rocking actuator is not limited to the illustrated one and a rocking actuator of any other mechanism may be used.

As described hereinabove in detail, by virtue of the fact that a hydraulic cylinder of a relatively small stroke or a rocking actuator of a small rotational angle is used and it is aided by the operation of a control mechanism to rotate a rotor through a wide range, the present invention has the effect of providing a rotor driving mechanism which is not only simple in construction, small in size and light in weight but also low in cost.

I claim:

1. A rotary nozzle attached to a bottom of a molten steel vessel comprising:

a rotor having a sliding plate brick mounted thereon, said rotor and said sliding plate brick are rotatable to adjust the degree of opening of a nozzle bore so as to control a pouring rate of molten steel;

engaging means formed on an outer periphery of said rotor; and rotatable turning means arranged to rotate said rotor, said turning means including detent means for engagement with said engaging means, and locking means to bring said detent means into and out of engagement with said engaging means so that the turning means can both rotate with, and rotate independently from, the rotor, said turning means being connected to an actuator of a hydraulic cylinder attached to said molten steel vessel.

2. A rotary nozzle according to claim 1, wherein the construction of said engaging means, detent means and turning means comprises engaging means including a plurality of notches formed at equal intervals on the outer peripheral portion of said rotor, and turning means rotatably arranged along said rotor and including detent means adapted for engagement with said engaging means and locking means for bringing said detent means into and out of engagement with said engaging means, and wherein said turning means is connected to the actuator of said hydraulic cylinder attached to said molten steel vessel.

3. A rotary nozzle according to claim 2, wherein said engaging means comprised a gear formed on an outer periphery of said turning means, wherein a rocking actuator is included in place of said hydraulic cylinder, and the gear of said turning means is connected to another gear connected to an output side of said rocking actuator.

4. A rotary nozzle according to claim 2, wherein said locking means comprises said detent means formed into a substantially Z shape, including at one end thereof a detent portion and having a substantially intermediate portion thereof pivoted to said turning means, and a second hydraulic cylinder attached to said turning means and having an actuator connected to the other end of said detent means.

5. A rotary nozzle according to claim 2, wherein said engaging means comprises a gear formed on the outer periphery of said rotor, and said locking means comprises substantially triangular rocking means having on both sides thereof locking pawls constituting said detent means and pivoted to said turning means and resilient means having a controllable spring force and arranged on each side of said rocking means to control rocking motion thereof.

6. A rotary nozzle according to claim 3, wherein said locking means comprises said detent means formed into a substantially Z shape, including at one end thereof a detent portion and having a substantially intermediate portion thereof pivoted to said turning means, and a second hydraulic cylinder attached to said turning means and having an actuator connected to the other end of said detent means.

7. A rotary nozzle according to claim 3, wherein said engaging means comprises a gear formed on an outer periphery of said rotor, and said locking means comprises substantially triangular rocking means having on both sides thereof locking pawls constituting said detent means and pivoted to said turning means, and resilient means having a controllable spring force and arranged on each side of said rocking means to control rocking motion thereof.

8. A rotary nozzle according to claim 1, wherein the construction of said engaging means, detent means and turning means comprises belt means having a lining on an inner surface thereof and arranged on an outer peripheral portion of said rotor, and connecting means fastened to the ends of said belt means and having a function of tightening and loosening said belt means, said connecting means being connected to the actuator of said hydraulic cylinder.

9. A rotary nozzle according to the claim 8, wherein said connecting means include a pair of arm portions and a body portion so as to be formed into substantially Y shapes, wherein said arm portions are respectively fastened to the ends of said belt means, and wherein said body portion incorporates a second hydraulic cylinder having an actuator projected through said body portion, said actuator having attached to one end thereby brake means pressed against the outer periphery of said rotor.

10. A rotary nozzle according to claim 2, wherein said detent means is formed at one end of a piston rod of a piston operated by a second hydraulic cylinder attached directly to said turning means, and wherein said detent means is brought into and out of engagement with said notched engaging portions by said locking means.

* * * * *